US005095979A

United States Patent [19]

Perricone

[11] Patent Number: 5,095,979

[45] Date of Patent: Mar. 17, 1992

[54] APPARATUS FOR OPERATING A DOWNHOLE TOOL USING COIL TUBING

[75] Inventor: James M. Perricone, Spring, Tex.

[73] Assignee: Petro-Tech Tools Incorporated, Houston, Tex.

[21] Appl. No.: 551,856

[22] Filed: Jul. 12, 1990

[51] Int. Cl.[5] ..... E21B 23/067; E21B 33/129

[52] U.S. Cl. ..... 166/138; 166/240; 166/384

[58] Field of Search ..... 166/77, 138, 140, 385, 166/240, 384, 387

[56] References Cited

U.S. PATENT DOCUMENTS

| | | | |
|---|---|---|---|
| 3,054,454 | 9/1962 | Evans | 166/138 X |
| 3,282,343 | 11/1966 | Tausch | 166/138 |
| 4,273,464 | 6/1981 | Scott | 403/348 |
| 4,625,799 | 12/1986 | McCormick | 166/240 X |
| 4,655,289 | 4/1987 | Schoeffler | 166/320 |
| 4,750,560 | 6/1988 | Gazda | 166/240 |
| 4,949,792 | 8/1990 | Rubbo et al. | 166/382 |

*Primary Examiner*—Stephen J. Novosad
*Attorney, Agent, or Firm*—Vaden, Eickenroht, Thompson & Boulware

[57] ABSTRACT

Apparatus is disclosed for operating a downhole tool, such as setting and unsetting a hook wall packer run into the production tubing of an oil or gas well on coiled tubing. The apparatus employs a pin moving in a groove to allow a packer to be run into the production tubing, set, and released by the longitudinal movement of the coiled tubing only.

3 Claims, 2 Drawing Sheets

APPARATUS FOR OPERATING A DOWNHOLE TOOL USING COIL TUBING

This invention relates to an apparatus for operating a downhole tool using coil tubing.

Coil tubing cannot be rotated. Therefore, heretofore downhole tools that require rotation cannot be used. As a result, for example, hydraulically set packers are the only types of packers that can be used. Conventional hook wall packers cannot be used because they require rotation of the tubing, which can't be done with coil tubing. Coil tubing can be reciprocated, however, and therefore, it is an object of this invention to provide apparatus for operating downhole tools, such as hook wall packers, that will operate a downhole tool in the well production tubing in which it is operating simply by reciprocating the coil tubing.

It is a further object and feature of this invention to provide such an apparatus that employs two control elements that are allowed to move longitudinally relative to each other in a predetermined manner to operate a well tool.

It is another feature and object of this invention to provide such an apparatus in which one of the elements of the apparatus is provided with a groove and the other element is provided with a pin that moves in the groove with the predetermined design of the groove determining the length of relative movement between the two elements each time the tubing is reciprocated.

It is a further object and advantage of this invention to provide such a setting tool in which the pin can rotate around the longitudinal axis of the first and second element to thereby freely follow the course of the groove in which the pin is located without requiring relative rotation of the two elements.

These and other objects, advantages, and features of this invention will be apparent to those skilled in the art from a consideration of this specification, including the attached drawings and appended claims.

IN THE DRAWINGS

Figure 1A:
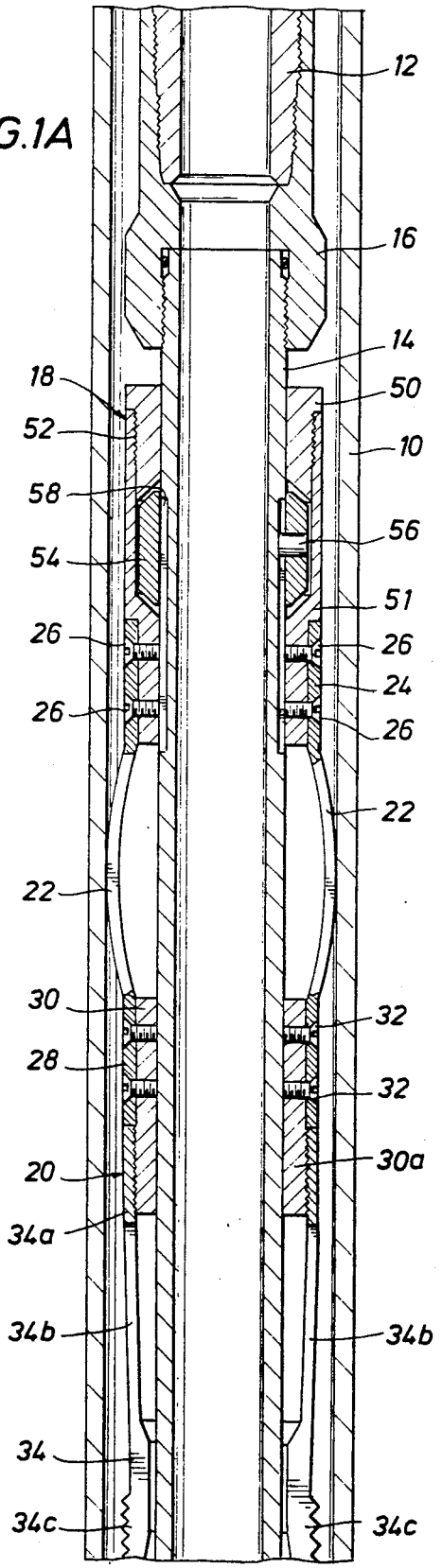
FIGS. 1A and 1B are longitudinal sectional views of the apparatus of this invention assembled with a hook wall packer.
Figure 1B:
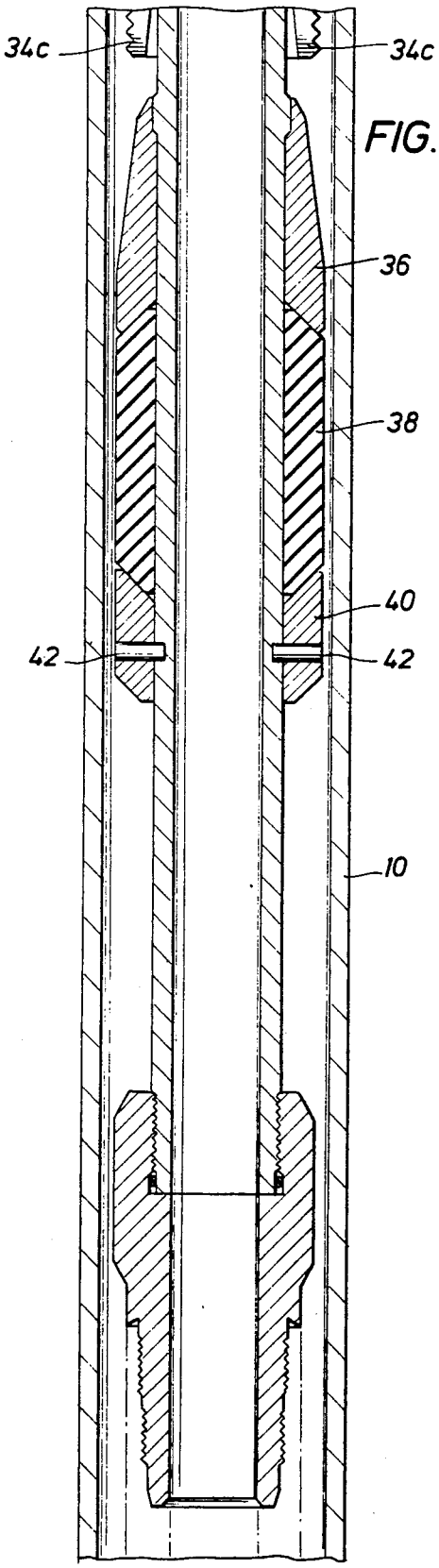

The operation of the apparatus of this invention will be described as it is used to set a hook wall packer and will be hereinafter referred to as the "setting tool".

The setting tool and packer assembly is shown in the drawings located in well tubing 10, which is usually the production tubing of an oil or gas well that is being worked over in some manner by using coil tubing. Coil tubing 12 is connected to mandrel 14 of the packer by sub 16. Located below sub 16 is the setting tool assembly, generally indicated by the number 18.

Attached to the setting tool is slip assembly 20. The slip assembly includes bow springs 22, only two of which are shown in the drawings, the upper ends of which are connected to the lower end of tubular section 51 by screws 26. The lower end of the bow springs are connected to sleeve 30 by screws 32. Sleeve 30 extends downwardly to provide threaded portion **30*a* for connecting to the upper end of collet 34. The collet includes annular section 34*a* that is connected to the threaded portion 30*a* of sleeve 30 and fingers 30*b* that support slip segments 34*b* and 34*c***. There may be three or four or more slips.

Below the slips on the mandrel is slip cone 36 having the conventional tapered outer surface. Packing element 38 is positioned between cone 36 and packer head 40, which is attached to the mandrel by a plurality of shear pins 42.

The parts just described make up a conventional tension set hook wall packer. Such packers are set by causing the mandrel to move upwardly relative to the slips. This moves cone 36 under the slips forcing them outwardly into engagement with the inner wall of the well tubing. Continued upward movement of the mandrel will move packer head 40 upwardly compressing packing element 38 between the cone and the packer head forcing it outwardly and inwardly into sealing engagement with the mandrel and the wall of the well tubing.

To release the packer, the coil tubing is moved downwardly moving the slip cone away from slips **34*c* to allow them to move inwardly out of engagement with the wall of the well bore, freeing the tool for removal from the tubing. If for some reason the friction between the slips and the packer cone is such that they won't release readily due to the force being exerted on them by the compressed packing element, then continued upward force by the coil tubing will shear pins 42 allowing packer head 40** to drop away relieving the compressive force on the packing element. The packing element and the cone will also drop down thereby allowing the slips to move away from the wall of the well tubing.

To accomplish the setting and unsetting of this packer without rotating the tubing string on which it is supported is the function of setting tool 18 The tool includes first and second elements each of which are connected to portions of the well tool which is set and unset by predetermined relative longitudinal movements of the two elements. The first element includes a housing made up of two tubular sections 50 and 51 that are connected together by threads 52. Section 50 has an upper portion of increased diameter in which is located control ring 54. Control pin 56 is mounted in the wall of control ring 54 and extends inwardly into engagement with groove 58 on the outside surface of mandrel 14, which in this embodiment is the second element of the setting tool. As explained above, the bow springs, which are a part of the apparatus of this invention, are attached to the lower end of tubular section 51 of the setting tool and therefore the movement of the first element of the setting tool will determine the movement of the slips that are connected directly to the bow springs.

Figure 2:
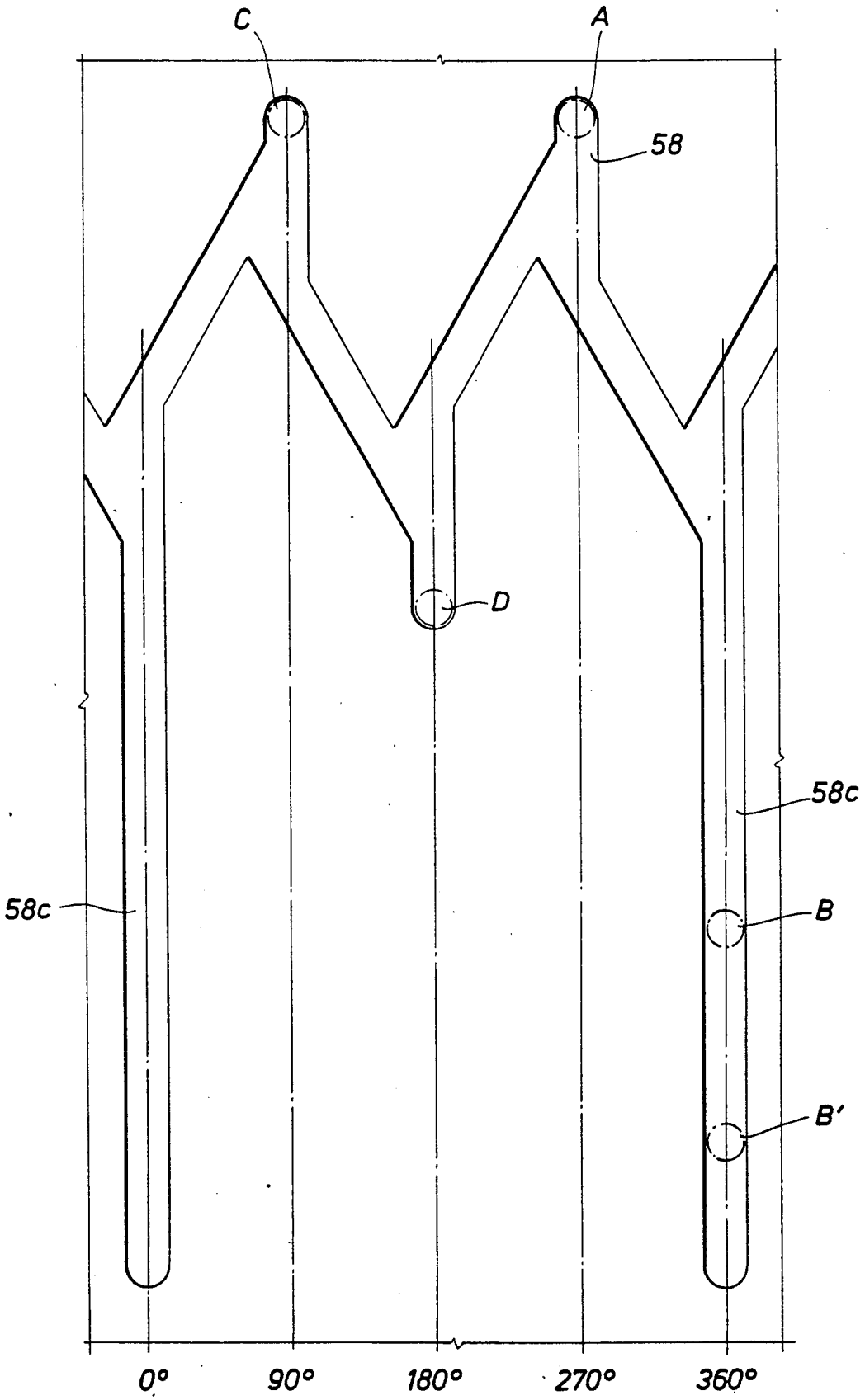
FIG. 2 is a plan view of the groove in which the pin operates to control the relative movement of the two elements of the apparatus.

A plan view of groove 58 is shown in FIG. 2. When the packer assembly is being lowered into the well tubing, pin 56 will be in position A and that way the engagement of the upper end of the groove with the pin will force the first element of the setting tool and the slip assembly to move through the well tubing in the position shown in FIG. 1A. When the packer reaches the desired depth, upward movement of mandrel 14 will cause pin 56 to move downwardly to position B in section **58*c* of the groove. The cone is now holding the slips in engagement with the well tubing. Continued upward movement of the mandrel to move upwardly compresses the packing element and sets the packer. At that point, the pin will have moved downwardly toward the lower end of the groove as indicated by position B'. When it is desired to retrieve the packer, the tension is relieved on the mandrel and it is allowed to move downwardly at which time the pin will move upwardly through leg 58***c* of the groove to position C. If the slips release properly, then as the tubing is moved upwardly to pull the packer out of the hole, the mandrel will be moved upwardly with the tubing and the pin will move downwardly through leg 58*d* of the groove to position D. In this position, the slip assembly will be held away from the slip cone and allow the packer to be pulled out of the well tubing.

If pin 56 was mounted directly in the wall of housing section 51, for the pin to travel around the groove as described above, there would need to be relative rotation between the mandrel and the slip assembly. But, in accordance with this invention, to avoid having to produce such relative rotation, the pin is mounted in annular member 54, which is free to rotate relative to housing 18. This allows the pin to follow the groove to its various positions without requiring relative rotation of the setting tool housing and the mandrel.

From the foregoing it will be seen that this invention is one well adapted to attain all of the ends and objects hereinabove set forth, together with other advantages which are obvious and which are inherent to the apparatus and structure.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A packer for running on coiled tubing inside a well tubing that can be set by reciprocation of the tubing comprising a mandrel for attaching to the end of the coiled tubing, a lower packer head attached to the mandrel, an annular packing element on the mandrel supported by the packer head, an upper packer head having a conical outer surface, a slip assembly carried by the mandrel and including slips and means for engaging the well tubing and frictionally resisting movement of the slip means through the well casing, and means connecting the slip assembly to the mandrel to limit upward movement of the slip means relative to the mandrel as the packer is being run into the well tubing and upon reciprocation of the mandrel for allowing the mandrel to move upwardly moving the outer conical surface of the upper packer head under the slips forcing the slips into engagement with the well tubing to hold the upper packer head against further upward movement to allow continued upward movement of the mandrel to compress the packing element between the upper and lower packer heads and force the packing element into sealing engagement with the mandrel and the well tubing.

2. The packer of claim 1 in which the slip assembly is connected to the mandrel by a pin connected to the assembly and in engagement with a groove in the outer surface of the mandrel, said groove being designed to engage the pin and force the pin to move with the mandrel as the packer is lowered through the well tubing, to allow upward movement of the mandrel relative to the pin when the packer reaches the desired depth in the well tubing far enough to set the packer, and upon downward movement of the mandrel to release the packer and upon upward movement of the mandrel to limit the relative movement of the mandrel and the slip assembly to hold the slips out of engagement with the upper cone as the packer is pulled from the well tubing.

3. The packer of claim 2 in which the slip assembly includes an annular body mounted on the mandrel encircling the groove in the mandrel, said body having an internal annular groove, an annular member located in the groove for rotation relative to the annular groove in the body and in which the pin engaging the groove in the mandrel is carried by the annular member to allow the pin to follow the grove in the mandrel without rotating the slip assembly.

* * * * *